US010876321B1

(12) United States Patent
Frydrych

(10) Patent No.: US 10,876,321 B1
(45) Date of Patent: Dec. 29, 2020

(54) LOCKS CONFIGURED TO DETER CYLINDER REMOVAL

(71) Applicant: Robert Frydrych, Troutville, VA (US)

(72) Inventor: Robert Frydrych, Troutville, VA (US)

( * ) Notice: Subject to any disclaimer, the term of this patent is extended or adjusted under 35 U.S.C. 154(b) by 0 days.

(21) Appl. No.: 14/522,088

(22) Filed: Oct. 23, 2014

Related U.S. Application Data

(60) Provisional application No. 61/895,350, filed on Oct. 24, 2013.

(51) Int. Cl.
*E05B 15/00* (2006.01)
*E05B 15/16* (2006.01)
*E05B 9/08* (2006.01)

(52) U.S. Cl.
CPC ..... *E05B 15/00* (2013.01); *E05B 9/08* (2013.01); *E05B 15/1614* (2013.01)

(58) Field of Classification Search
CPC ..... E05B 9/084; E05B 15/00; E05B 13/002; E05B 15/1614; E05B 9/08
USPC ..... 70/370, 371, 416, 417, 448, 449, 451, 70/466
See application file for complete search history.

(56) References Cited

U.S. PATENT DOCUMENTS 971,333 A * 9/1910 Voight ..... 70/370
1,122,862 A * 12/1914 Cleaver ..... 70/370
1,505,524 A * 8/1924 Augenbraun ..... E05B 9/084 70/370
2,629,248 A * 2/1953 Burdick ..... 70/370
3,448,599 A * 6/1969 Schreiber ..... 70/371
3,455,129 A * 7/1969 Forbes et al. ..... 70/370
3,606,422 A * 9/1971 Hennessy ..... E05B 63/0017 292/139
3,745,795 A * 7/1973 Sanders ..... E05B 9/084 70/370
5,063,765 A * 11/1991 Squire ..... E05B 15/1614 70/417
6,564,603 B1 * 5/2003 O'Neill ..... E05B 9/084 70/371
2002/0026817 A1 * 3/2002 Greer ..... 70/370
2003/0019257 A1 * 1/2003 Simon et al. ..... 70/224

* cited by examiner

*Primary Examiner* — Christopher J Boswell
*Assistant Examiner* — Amanda L Bailey
(74) *Attorney, Agent, or Firm* — Rhodes IP PLC; Christopher R Rhodes

(57) ABSTRACT

Certain embodiments described herein are directed to locks that include one or more cylinder members effective to deter removal of a lock cylinder. In some configurations, the cylinder member is configured to engage a circumferential surface of the lock cylinder to deter removal of the lock cylinder on circumferential rotation of the lock cylinder. In other instances, the cylinder member is configured to etch the lock cylinder upon circumferential rotation of the lock cylinder.

7 Claims, 9 Drawing Sheets

LOCKS CONFIGURED TO DETER CYLINDER REMOVAL

PRIORITY APPLICATION

This application is related to, and claims priority to, U.S. Provisional Application No. 61/895,350 filed on Oct. 24, 2013, the entire disclosure of which is hereby incorporated herein by reference for all purposes.

BACKGROUND

Locks permit unwanted entry into commercial buildings, residences and other dwellings. Locks can be defeated by various measures to permit unwanted entry into the buildings.

SUMMARY

In a first aspect, a lock assembly comprising a lock cylinder, a face plate configured to receive a portion of the lock cylinder, a back plate configured to receive another portion of the lock cylinder, and a cylinder member configured to permit engagement of a cylindrical surface of the lock cylinder and deter removal of a lock cylinder after circumferential rotation of the lock cylinder is provided.

In certain embodiments, the cylinder member is configured to deter removal of a lock cylinder after circumferential rotation of the lock cylinder by at least 45 degrees, at least 60 degrees, at least 75 degrees or at least 90 degrees. In other embodiments, the cylinder member comprises a threaded boss. In some configurations, the threaded boss is configured to permit engagement of the lock cylinder at about 90 degrees, at about 270 degrees, between 180 degrees and 270 degrees or between 270 degrees and 360 degrees. In certain configurations, the threaded boss can be configured to permit engagement of a groove of the lock cylinder. In some instances, the threaded boss can be configured to permit etching of lock cylinder upon circumferential rotation to deter removal of the lock cylinder. In certain configurations, the assembly may comprise a second cylinder member configured to permit engagement of the lock cylinder at another cylindrical surface of the lock cylinder.

In another aspect, a lock kit comprising a lock cylinder and a cylinder member configured to permit engagement of a cylindrical surface of the lock cylinder and deter removal of a lock cylinder after circumferential rotation of the lock cylinder is described.

In certain embodiments, the cylinder member is configured to deter removal of a lock cylinder after circumferential rotation of the lock cylinder by at least 45 degrees or at least 60 degrees, 75 degrees or 90 degrees. In other embodiments, the cylinder member comprises a threaded boss. In certain instances, the threaded boss can be configured to permit engagement of the lock cylinder at about 90 degrees, at about 270 degrees, between 180 degrees and 270 degrees, or between 270 degrees and 360 degrees. In certain configurations, the threaded boss can be configured to permit engagement of a groove of the lock cylinder. In some instances, the threaded boss can be configured to permit etching of the lock cylinder upon circumferential rotation to deter removal of the lock cylinder. In certain examples, the lock kit may comprise a second cylinder member configured to permit engagement of the lock cylinder at another cylindrical surface of the lock cylinder.

In an additional aspect, a door assembly comprising a door and a lock assembly in the door is described. In some instances, the lock assembly of the door comprises a lock cylinder, a face plate configured to receive a portion of the lock cylinder, a back plate configured to receive another portion of the lock cylinder, and a cylinder member positioned substantially orthogonal to the longitudinal axis of the lock cylinder and configured to permit engagement of a cylindrical surface of the lock cylinder to deter removal of a lock cylinder after circumferential rotation of the lock cylinder.

In some configurations, the cylinder member is configured to deter removal of a lock cylinder after circumferential rotation of the lock cylinder by at least 45 degrees, at least 60 degrees, at least 75 degrees or at least 90 degrees. In certain examples, the cylinder member comprises a threaded boss. In some instances, the threaded boss can be configured to permit engagement of the lock cylinder at about 90 degrees, 270 degrees, between 180 degrees and 270 degrees, or between 270 degrees and 360 degrees. In certain configurations, the threaded boss can be configured to permit engagement of a groove of the lock cylinder. In some embodiments, the threaded boss can be configured to permit etching of the lock cylinder upon circumferential rotation to deter removal of the lock cylinder. In certain instances, the door assembly comprises a second cylinder member configured to permit engagement of the lock cylinder at another cylindrical surface of the lock cylinder.

In another aspect, a lock kit comprising a lock cylinder, at least one plate configured to receive a portion of the lock cylinder, a cylinder member configured to permit engagement of a cylindrical surface of the lock cylinder to deter removal of a lock cylinder after circumferential rotation of the lock cylinder, and instructions for using the lock cylinder, the plate and the cylinder member to provide an operable lock is described.

In certain examples, the at least one plate is configured to engage the lock cylinder at a base of the lock cylinder to retain the lock cylinder in the operable lock. In other examples, the cylinder member is configured to deter removal of a lock cylinder after circumferential rotation of the lock cylinder by at least 45 degrees, at least 60 degrees, at least 75 degrees or at least 90 degrees. In some instances, the cylinder member comprises a threaded boss. In certain embodiments, the threaded boss can be configured to permit engagement of the lock cylinder at about 90 degrees, 270 degrees, between 180 degrees and 270 degrees, or between 270 degrees and 360 degrees. In certain configurations, the threaded boss can be configured to permit engagement of a groove of the lock cylinder. In some embodiments, the threaded boss can be configured to permit etching of the lock cylinder upon circumferential rotation to deter removal of the lock cylinder. In certain instances, the lock kit comprises a second cylinder member configured to permit engagement of the lock cylinder at another cylindrical surface of the lock cylinder.

In another aspect, a lock assembly comprising a lock cylinder and a cylinder member configured to engage a cylindrical surface of the lock cylinder at a substantially orthogonal angle to a longitudinal axis of the lock cylinder, the cylinder member configured to receive a set screw that engages the cylindrical surface of the lock cylinder, the cylinder member configured to deter removal of a lock cylinder after circumferential rotation of the lock cylinder by etching of the lock cylinder by the set screw upon the circumferential rotation of at least 45 degrees, the cylinder member configured to permit release of the lock cylinder from the lock assembly upon application of a longitudinal force to the lock cylinder is provided.

In certain embodiments, the cylinder member is configured to deter removal of a lock cylinder after circumferential rotation of the lock cylinder by at least 60 degrees, or at least 75 degrees or at least 90 degrees. In some configurations, the cylinder member comprises a threaded boss. In other instances, the threaded boss can be configured to permit engagement of the lock cylinder at about 270 degrees, or between 180 degrees and 270 degrees, or between 270 degrees and 360 degrees. In certain configurations, the threaded boss can be configured to permit engagement of a groove of the lock cylinder. In some instances, the lock assembly further comprises a second cylinder member configured to permit engagement of the lock cylinder at another cylindrical surface of the lock cylinder. In other embodiments, the cylinder member and the additional cylinder member can be configured to be positioned about 180 degrees from each other, or less than 180 degrees from each other or less than 120 degrees from each other.

Additional aspects, configurations, examples, embodiments and features are described in more detail below.

BRIEF DESCRIPTION OF THE SEVERAL VIEWS OF THE DRAWINGS

Certain configurations and aspects are described in more detail below in which.

Figure 1A:
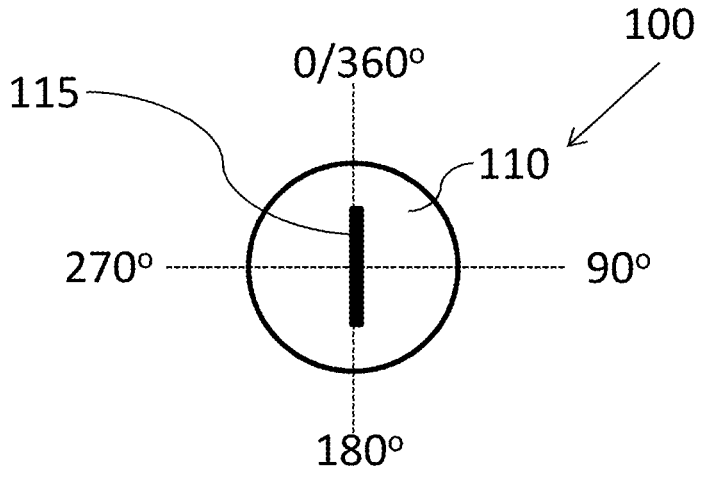
FIGS. 1A and 1B are illustrations of a lock cylinder, in accordance with certain configurations.

It will be recognized by the person of ordinary skill in the art, given the benefit of this disclosure, that the particular dimensions, sizes and arrangements of the components shown in the figures may vary depending on the intended use of the lock assembly and/or the components therein.

DETAILED DESCRIPTION

Certain configurations are described herein with reference to a cylinder member configured to permit engagement of a circumferential surface of a lock cylinder. In some instances, the cylinder member can be positioned adjacent to a circumferential surface of a lock cylinder to permit a set screw to engage the circumferential surface (or a groove therein) and can provide reinforcing strength to the set screw to prevent or reduce the likelihood of shearing of the set screw. For example, the cylinder member can be positioned adjacent to the lock cylinder in a generally orthogonal manner and permit the set screw to engage the surface of the lock cylinder. While various configurations for the cylinder members and lock members are described, additional configurations that can provide the same function will be readily selected by the person of ordinary skill in the art, given the benefit of this disclosure. Various configurations of the lock designs described herein can alter certain features used to keep the lock cylinder in place by strengthening the side housing of the lock body with a cylinder member, e.g., a member comprising a threaded boss (or other similar or comparable structure) that would allow, for example, the tip of the set screw to engage a circumferential surface of the lock cylinder. In other instances, the cylinder member can be configured to permit the set screw to protrude no more than the depth of the lock cylinder contoured grooves. These pre-determined grooves are typically set to varying depths by each manufacturer, but are normally not less than ⅛" and not more than 3⁄16". Certain configurations described herein can narrow the distance greatly between the cylinder groove and the inside face of the cylinder member to provide for enhanced strength at the intersection point of the set screw and the lock cylinder. These configurations can prevent or deter the ability of forcing the cylinder from the lock body as described below. Various types of set screws can be used with the cylinder members described herein, and in certain instances Allen set screws are used, e.g., hardened steel Allen head set screws.

In certain instances, the term cylinder member is used herein in reference to various lock assemblies. The cylinder member itself is neither a set screw nor does it function as a set screw to be the primary mechanism/device to hold the lock cylinder in the lock assembly. Instead, the cylinder member is a secondary member that can act to strengthen the lock assembly by providing reinforcement to the set screw to prevent unwanted removal of the lock cylinder upon circumferential rotation. The presence of a cylinder member generally does not interfere with the functioning of the lock cylinder, e.g., the movement of pins, cams or other components of the lock cylinder.

Figure 1B:
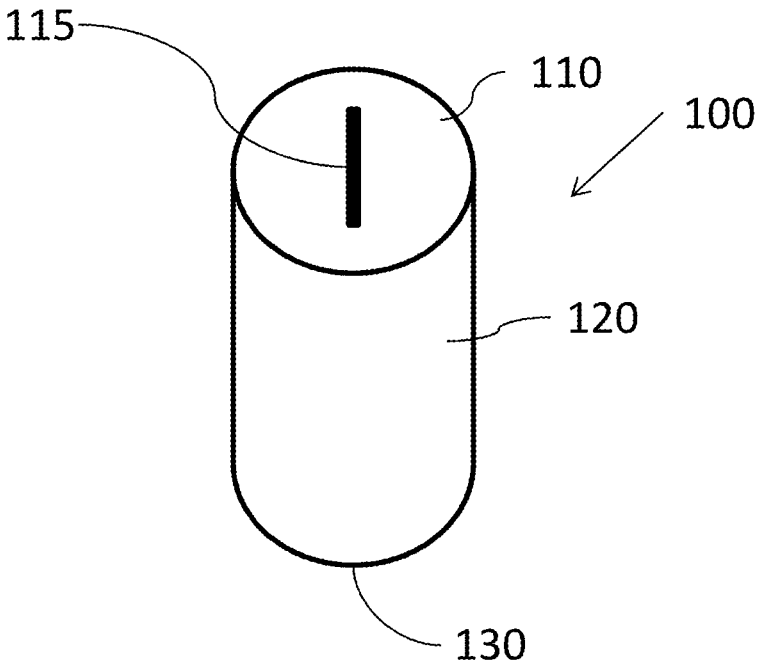

In certain configurations, an illustration of a lock cylinder is shown in FIGS. 1A and 1B. The lock cylinder 100 comprises a face 110, a body 120 comprising a cylindrical surface and a base 130. The lock cylinder 100 also comprises a keyhole 115. For reference purposes, the top dead center position of the lock cylinder 100 is referred to as the 0/360 degree position. Circumferential rotation counterclockwise by ninety degree places the 90 degree location at the top dead center. Circumferential rotation clockwise by ninety degrees places the 270 degree location at the top dead center. Circumferential rotation by 180 degrees places the 180 degree position at top dead center. As described in more detail below, a cylinder member can permit engagement of a circumferential surface of the body 120 to deter removal of the lock cylinder 100. For example, a cylinder member may comprise a threaded boss (or other comparable structure) that can receive a set screw that engages a cylindrical surface of the lock cylinder. The cylinder member provides additional strength to the set screw preventing (or reducing the likelihood) or being or shearing of the set screw. While not shown, one or more stops can be present on the cylinder 100. For example, a cylinder member can rest adjacent to or against the cylindrical surface of the body 120. Rotation of the cylinder by 90 degrees or less, e.g., 45 degrees, 60 degrees, 75 degrees or less, can result in etching, e.g., penetration of any set screw in the cylinder member, into the body 120. This engagement may result in etching of body 120 of the lock cylinder 100, which generally can fix the lock cylinder 100 in place and prevent removal of the lock cylinder 100.

Figure 2A:
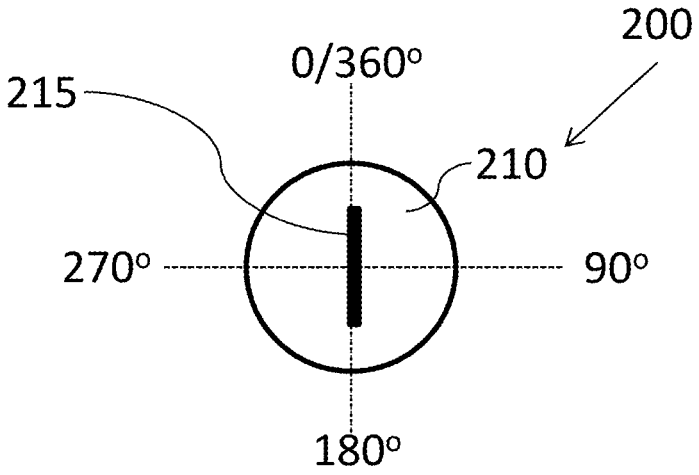
FIGS. 2A and 2B are illustrations of a lock cylinder comprising circumferential grooves, in accordance with certain configurations.
Figure 2B:
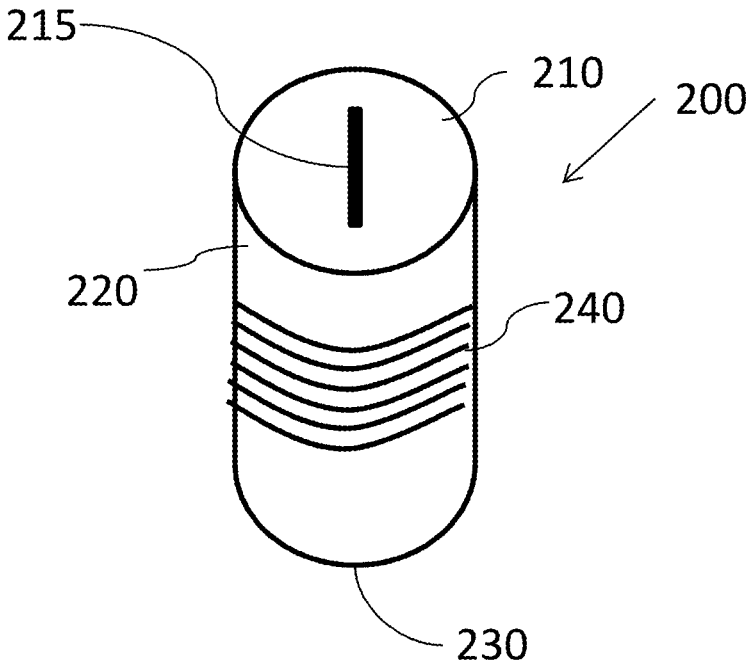

Another configuration of a lock cylinder is shown in FIGS. 2A and 2B. In this configuration, the lock cylinder 200 comprises a face 210, a body 220 comprising a cylindrical surface, a base 230 and a keyhole 215. In the body 220, there is a plurality of circumferential grooves, such as groove 240. The grooves in the lock cylinder 200 are configured as circumferential grooves spaced apart a desired distance along the longitudinal axis of the body 220. While the grooves are shown in the cylinder 200 as being positioned substantially centrally along the longitudinal axis of the cylinder 200, if desired the grooves can be positioned closer to the face 210 or the base 230. In other instances, the cylinder 200 may comprise circumferential grooves that are present substantially along the entire length of the body 220, e.g., grooves are present from the face 210 to the base 230. The exact depth of the grooves of the cylinder 200 can vary, but in certain instances, the grooves are sufficiently deep to engage a cylinder member, e.g., so a terminal point of the cylinder member resides in the circumferential groove. In some instances, the groove depth can vary from about 1/64 inches to about 1/4 inches. If desired, stops can be present in the grooves at the 0/360, 90, 180 and 270 locations such that rotation of the cylinder by less than 90 degrees will result in contact of the set screws and/or cylinder member with the stop of the cylinder 200. This engagement can act to deter removal of the lock cylinder and/or etching of the set screws into the lock cylinder to prevent removal of the lock cylinder. The added strength provided by the cylinder member reduces the likelihood of bending or shearing of the set screws. In some instances, the cylinder members described herein are inserted into the circumferential grooves but do not actually contact the lock body 220, e.g., the set screw contacts the cylinder body within one of the circumferential grooves. In additional configurations, the cylinder member may be adjacent to and above the grooves but still close enough to position the set screw in the grooves.

Figure 3A:
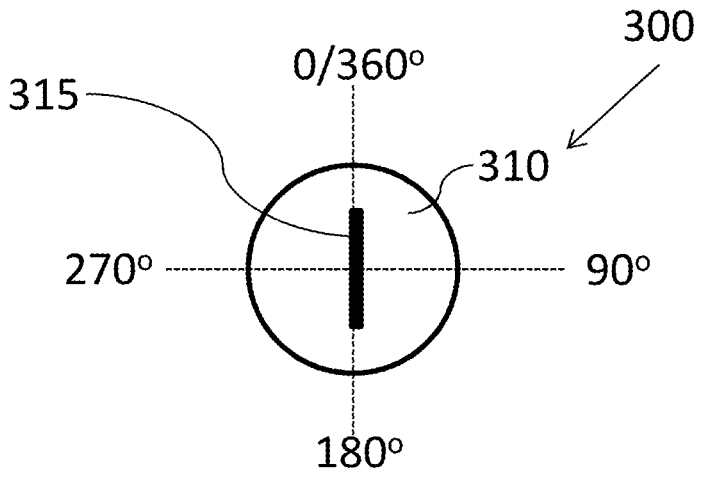
FIGS. 3A and 3B are illustrations of a lock cylinder comprising a longitudinal groove, in accordance with certain configurations.
Figure 3B:
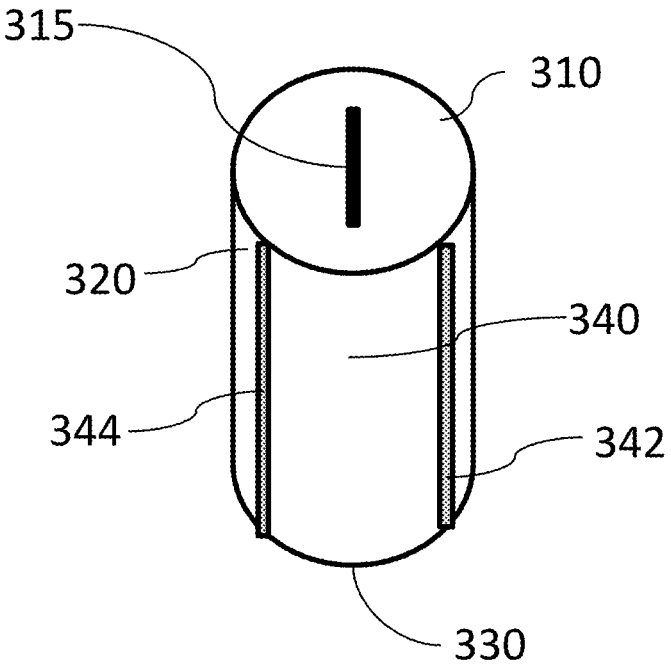

In an additional configuration, grooves can be present along the longitudinal axis of the lock cylinder. Referring to FIGS. 3A and 3B, a lock cylinder 300 comprises a face 310, a body 320 comprising a cylindrical surface, a base 330 and a keyhole 315. In the body 320, there is at least one longitudinal groove 340. The grooves in the lock cylinder 300 can be separated by projections or stops 342, 344 spaced apart a desired distance around the circumference of the body 320. The exact number of longitudinal grooves present can be 1, 2, 3, 4, 5, 6, 7, 8, 9, 10 or more. In some instances, 4 longitudinal grooves are present and spaced substantially equally around the circumference of the cylinder body 320. In use of the cylinder 300 with a cylinder member, the cylinder member can permit engagement of the groove 340, e.g., can be positioned adjacent to or in the groove 340 to permit a set screw to contact the body 320. Upon circumferential rotation of the cylinder 300, the cylinder member may hit the stops 342, 344 and can permit a set screw in the cylinder member to etch the cylinder at these sites to lock the cylinder into the set screw(s) and prevent removal of the cylinder from the lock assembly. The exact depth of the grooves of the cylinder 300 can vary, but in certain instances, the grooves are sufficiently deep to engage a set screw in the cylinder member, e.g., so a terminal point of a set screw in the cylinder member resides in the circumferential groove. If desired, longitudinal stops can be present in the grooves at the 0/360, 90, 180 and 270 locations such that rotation of the cylinder by less than 90 degrees will result in contact of the longitudinal stops with the cylinder member. This engagement can act to deter removal of the lock cylinder and/or etching of the set screws into the lock cylinder to prevent removal of the lock cylinder. In some instances, the cylinder member is positioned substantially orthogonal to the groove 340, whereas in other examples, the cylinder member can be positioned substantially parallel to the groove 340. For example, where the set screws are inserted through the back plate of the lock assembly, the cylinder member can be positioned in a substantially parallel direction to the longitudinal axis of the groove 340.

While the cylinder 200 is shown as comprising only circumferential grooves and the cylinder 300 is shown as comprising only longitudinal grooves, if desired, a cylinder may comprise both circumferential grooves and longitudinal grooves. The presence of both types of grooves can further assist in deterring removal of the lock cylinder and provide for additional flexibility in assembling the lock components described herein into an operable lock assembly.

Figure 4:
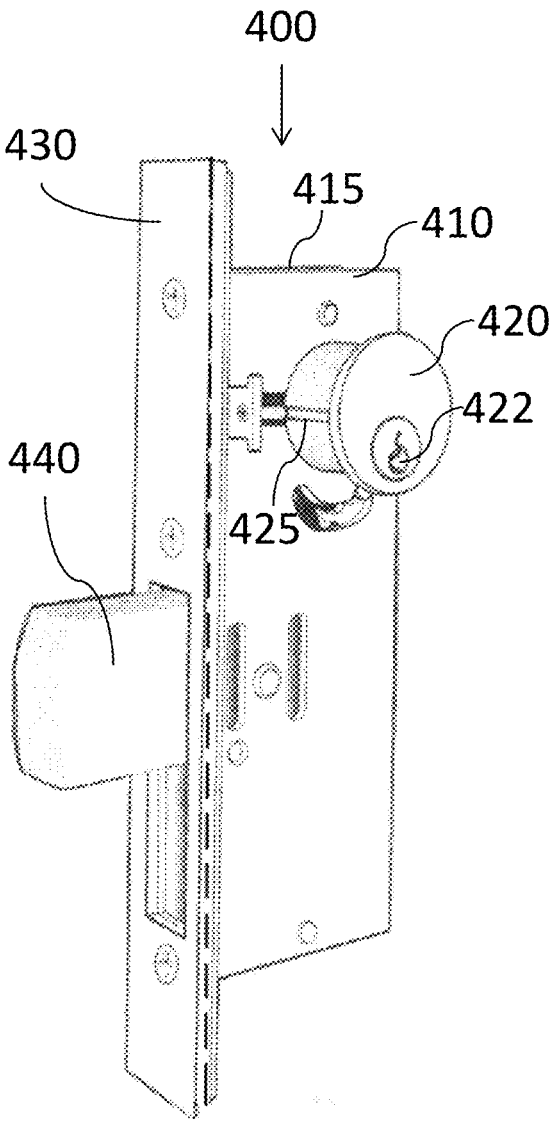
FIG. 4 is an illustration of a lock assembly, in accordance with certain examples.

In certain configurations and referring to FIG. 4, a lock assembly 400 is shown that comprises a face plate 410 and a lock cylinder 420. A back plate 415 is also present. In some instances, the back plate 415 can include features to permit engagement of the lock cylinder 420 such that insertion of screws through the back plate result in engagement of the cylinder 420 to hold the cylinder 420 in the lock assembly 400. A side plate 430 is shown that retains a latch assembly 440 that is actuated using the cylinder 420 and a key (not shown). The cylinder 420 comprises a longitudinal groove 425 that can engage a set screw within a cylinder member as described herein. For example, a cylinder member can be inserted in a generally orthogonal direction to the groove 425. A set screw can be placed through the cylinder member, e.g., through a threaded boss of the cylinder member. The boss provides additional strength to the set screw. Circumferential rotation of the cylinder 420 results in the set screw contacting the cylinder 420 and prevents removal of the cylinder 420 from the assembly 400. In a different configuration, the cylinder member may be positioned substantially parallel to the groove 425 as described in more detail herein.

Figure 5:
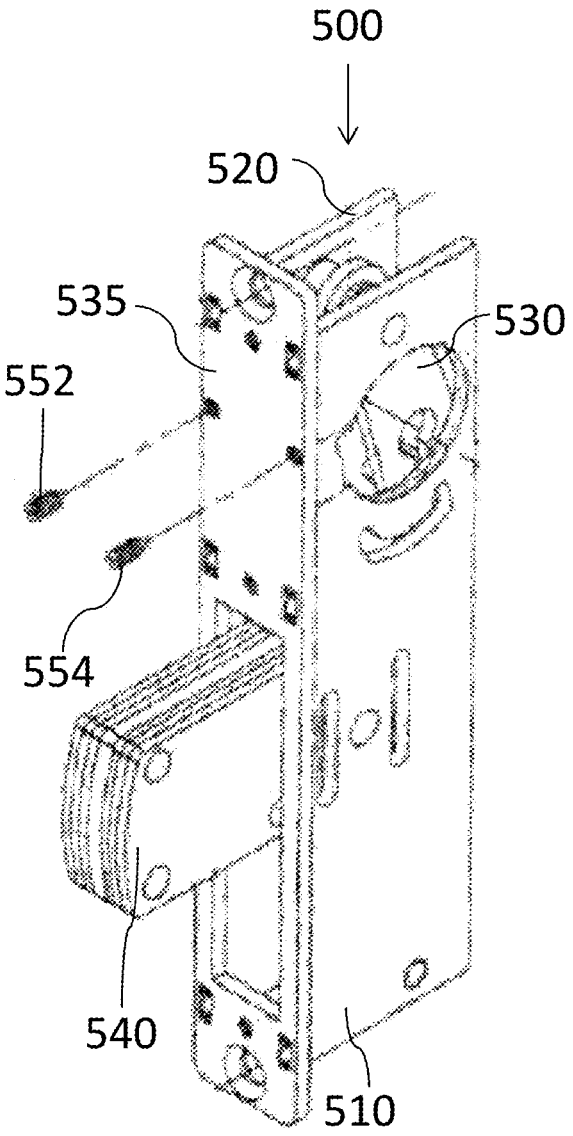
FIG. 5 is another illustration of a lock assembly, in accordance with certain examples.

In certain instances, as noted herein the cylinder may be retained in the lock assembly using one or more set screws that are inserted in a direction substantially orthogonal to the longitudinal axis of the cylinder body. Referring to FIG. 5, a lock assembly housing 500 is shown that comprises a face plate 510, a back plate 520, and an opening 530 designed to receive a lock cylinder to actuate a latch 540. In the assembly 500, two set screws 552, 554 are inserted in a generally orthogonal direction to the longitudinal axis of the lock cylinder (not shown) to retain the lock cylinder in the assembly 500. A cylinder member can be inserted below the set screws 552, 554 to act to retain the lock cylinder in the assembly 500 upon rotation of the lock cylinder. In some configurations, the cylinder member can be permanently coupled, e.g., welded to one or more of the plate of the lock assembly, e.g., to the face plate 510, the back plate 520 or to a side plate 535 through which the set screws are placed. The presence of a cylinder member can permit any threads present in the side plate 535 to be omitted. Instead, the side plate 535 may comprise an opening that permits insertion of the set screw(s) into the cylinder member. In other instances, a cylinder member can be inserted in the same general direction as the insertion direction of the set screws. A set screw can then be inserted through the side plate 535 and cylinder member to permit engagement of the lock cylinder, e.g., through a threaded boss of the cylinder member. If desired, a second cylinder member can be present for the other set screw to provide for additional strength to the lock assembly.

Figure 6:
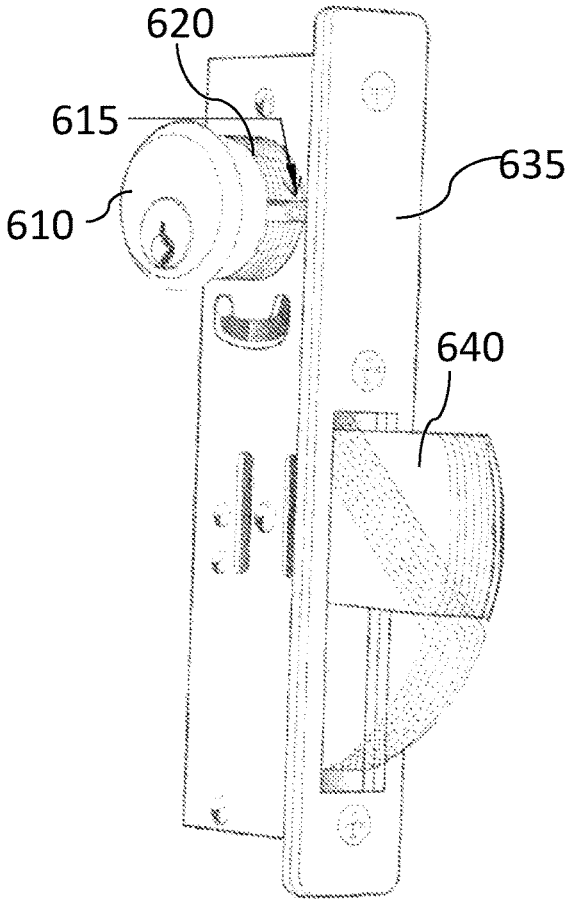
FIG. 6 is an additional illustration of a lock assembly, in accordance with certain examples.

In some embodiments and referring to FIG. 6, a lock assembly is shown where a cylinder member is present at about the 90 degrees position of the cylinder. The configuration of FIG. 5 permits insertion of a lock assembly at about the 270 degree position of the lock cylinder body. Depending on the exact location of the set screws, the cylinder member can be positioned at the 90 degrees position, between the 0 degree position and the 90 degrees position, between the 90 degrees position and the 180 degree position, the 270 degree position, between 270 degrees and 360 degrees or between 180 degrees and 270 degrees. The exact insertion point (or position) of the cylinder member depends, for example, one whether the door opens to the left or to the right, the size of the lock cylinder and the desired level of reinforcement. As shown in FIG. 6, the lock cylinder 610 comprises a longitudinal groove 615 and a plurality of circumferential grooves 620. A latch 640 is actuated using the cylinder 610 and a key. The cylinder member (not shown) can be inserted at about the 90 degrees position of the cylinder 610 in a manner to permit a set screw to engage the groove 615 and/or the grooves 620. For example, a set screw can be inserted through the side plate 635 and the cylinder member and into the groove 615 or the grooves 620 to retain the lock cylinder 610 in position. Upon circumferential rotation of the cylinder 610, the set screw can engage or otherwise penetrate into the lock cylinder 610 to prevent removal of the lock cylinder 610 after circumferential rotation. This configuration prevents or deters removal of the lock cylinder 610 to permit entry.

Figure 7:
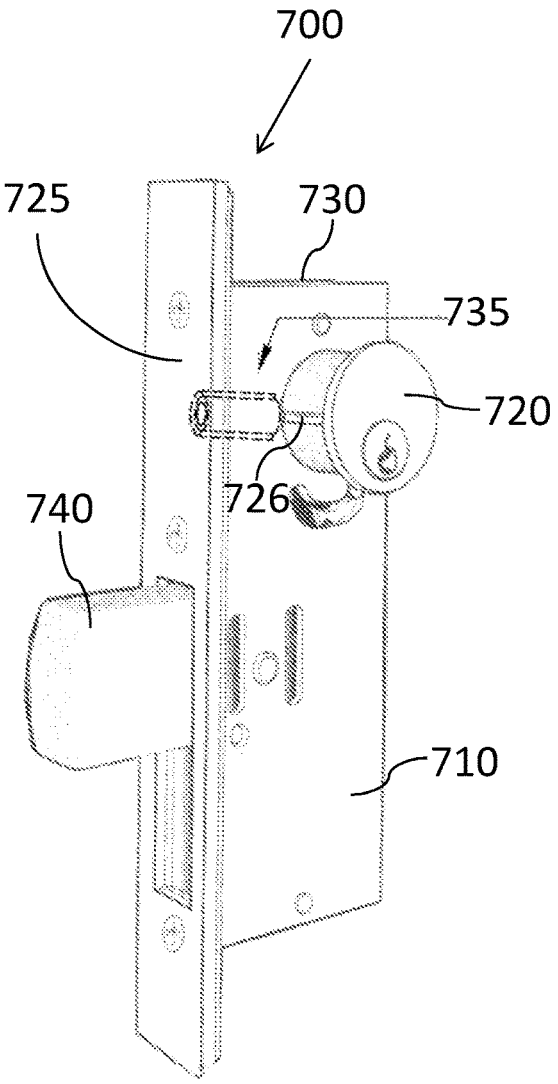
FIG. 7 is an illustration of a lock assembly showing a cylinder member installed into the lock assembly, in accordance with certain configurations.

In some instances, a set screw may engage a lock cylinder in a generally orthogonal direction, e.g., at about ninety degrees to the longitudinal axis of the lock cylinder, whereas in other instances, the set screw can engage the lock cylinder in a direction that is substantially parallel to the longitudinal axis of the lock cylinder. Referring to FIG. 7, a lock assembly comprising a face plate 710, a cylinder 720, a side plate 725, a back plate 730, and a cylinder member 735 are shown. As noted herein, the cylinder member 735 can be permanently coupled to one or more of the face plate 710, the side plate 725 and the back plate 730, e.g., can be welded to the side plate 725. A latch 740 that is actuated using the lock cylinder 720 and a key is also shown. The cylinder member 735 is positioned adjacent to (but does not necessarily contact) the cylinder 720 at a longitudinal groove 726 of the cylinder 720. As shown in FIG. 7, the cylinder member 735 is positioned adjacent to the groove 726 in a substantially orthogonal direction to the longitudinal axis of the cylinder 720 to permit insertion of a set screw through the cylinder member 735, e.g., though a threaded boss of the cylinder member 735. In operation of the assembly 700, if the cylinder 720 is circumferentially rotated more than about 90 degrees, then the set screw in the cylinder member 735 etches or otherwise contacts the cylinder 720 and prevents removal of the cylinder 720 upon additional application of a circumferential force, e.g., a force applied in the clockwise or counterclockwise direction of the face of the cylinder 720. Even though circumferential rotation of the cylinder 720 can prevent removal of the cylinder 720, the cylinder member 735 can be designed to permit fire personnel to gain access to the premises by applying a different force to the lock cylinder 720. For example, most fire rescue personnel in making frontal forced entries apply a force stress procedure which causes the cylinder to be pulled outward from the case body, e.g., in a longitudinal direction of the lock cylinder 720. By applying a longitudinal force, the cylinder 720 and the side housing of the body are stressed to the point of release. The increased strengthening of the cylinder member 735 should give/fail with the case body as well even if the cylinder member is included thru the face on the body. There is no obstruction on the cylinder housing along the groove 726 for the set screw that would prevent the release of the cylinder. If desired, the threads or grooves of the cylinder 720 can be very fine (as is the body's side wall).

Figure 8:
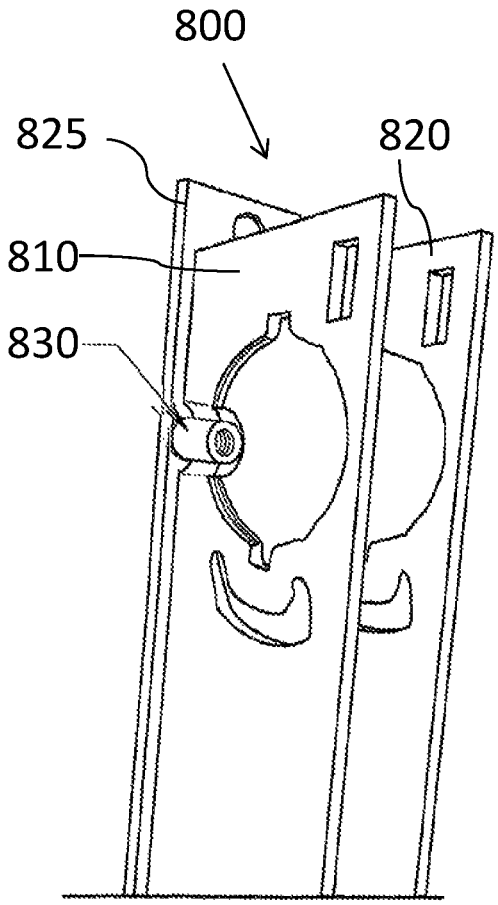
FIG. 8 is an illustration of a lock assembly showing a cylinder member positioned in a substantially orthogonal manner, in accordance with certain embodiments.

In certain embodiments, as noted herein the set screw of the lock assemblies can be inserted through the cylinder member of the lock assemblies described herein to provide a combined assembly that is stronger than the set screw by itself. In existing designs, when a cylinder is normally forced by the manner of rotating circumferentially from right to left in short distances, it can cause the set screw(s) to shear off between the face plate or bend to a point that will allow the cylinder to be removed. This result can happen even on those designs that use a separate plate to accommodate other back sets. The plate is generally closer to the cylinder but still too far to prevent damage. This process of forced entry could take as little as 10 to 20 seconds for a burglar to accomplish their intended purpose. Referring to FIG. 8, a perspective view of a lock assembly 800 is shown. The lock assembly comprises a face plate 810, a back plate 820, a side plate 825 and a cylinder member 830 shown as being permanently coupled to the side plate 825. The set screw (not shown) that retains the lock cylinder in the assembly 800 can be inserted through the threaded boss of the cylinder member 830 until it engages the lock cylinder (not shown). The additional strengthening provided by the cylinder member 830 can prevent shearing of the set screw during rotation of the lock cylinder. In addition, the cylinder member 830 can permit etching of the set screw into the lock cylinder to retain the lock cylinder in the assembly upon rotation of the lock cylinder. In some instances, the cylinder member etches into the lock cylinder upon circumferential rotation by at least 45 degrees, 60 degrees, 75 degrees, or 90 degrees. In other embodiments, the set screws (or additional set screws) can be placed above and/or below the cylinder member 830 to retain the lock cylinder in place prior to rotation.

In certain embodiments, the lock assemblies described herein can prevent the set screw from breaking or bending due to the length of the cylinder member, which can provide a narrow distance between the end of the threaded boss of the cylinder member and the position of the tip of the set screw into the groove of the lock cylinder. This threaded boss could vary in size to accommodate the multiple back sets of these locks. In the event that the cylinder is forced more than about 90 degrees in either direction, the rotation can cause the lock cylinder to become etched around the threaded area and make it very difficult to remove the lock cylinder from the assembly. In some instances, the threaded boss of the cylinder member is sufficiently long enough to support at least 25% of the length of the set screw, e.g., the last 25% of the set screw toward the tip of the set screw, or at least 50% of the length of the set screw or at least 75% of the length of the set screw of 100% of the length of the set screw. For example, the threaded boss can be sized and arranged so that it is 1-5% shorter than the length as the set screw to provide for threaded support along substantially the entire length of the set screw. In some instances, the cylinder member can be present in the lock assembly without any threads and an end-user may thread the cylinder member, e.g., using a tap, or can position a threaded insert within the cylinder member to provide threading.

Figure 9:
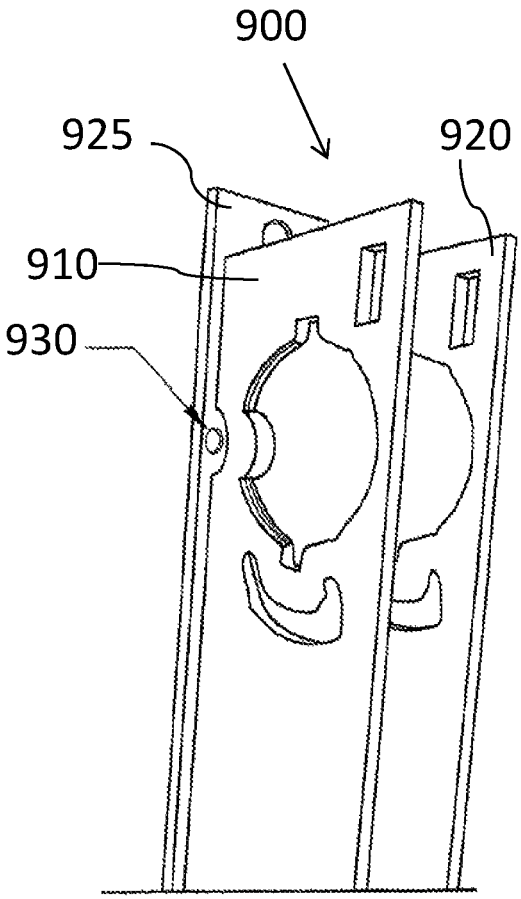
FIG. 9 is an illustration of a lock assembly showing a cylinder member positioned in a substantially parallel manner, in accordance with certain embodiments.

In certain configurations, a lock assembly may comprise a cylinder member that is positioned substantially parallel to a lock cylinder. Such parallel configurations may be desirable, for example, where the set screws are inserted into the assembly through a back plate of the lock assembly. In such instances, the cylinder member may be permanently coupled to the back plate, e.g., through one or more welds or by way of integral forging or casting of the cylinder member in the back plate. Referring to FIG. 9, a lock assembly 900 is shown comprising a face plate 910, a back plate 920, a side plate 925, and a cylinder member 930 positioned in a manner that is substantially orthogonal to the direction of a lock cylinder (not shown). The cylinder member 930 can engage a groove or feature in the lock cylinder to generally permit rotation of the lock cylinder beyond a desired number of degrees, e.g., less than 45, 60, 75, or 90 degrees. If desired, the cylinder member may comprise a threaded boss to receive the set screw of the assembly or may be threaded by an end-user. In some instances, upon rotation a desired number of degrees, any set screw with the cylinder member can etch or permanently engage the lock cylinder to prevent removal of the lock cylinder.

In certain embodiments, the exact length of the cylinder member and any threaded boss therein can be varied depending on the dimension of the lock assembly. For example, the cylinder members described herein generally reduce the distance between the inside of the bodies face plate and the contact point of the lock cylinder. While it is desirable to position the end of the cylinder member as close to the lock cylinder as possible, the exact length and width of the cylinder member may differ from lock to lock. Because the dimensions of lock assemblies vary, the length of the cylinder member and any threaded boss therein can likewise be varied to accommodate different lock assembly configurations.

Figure 10A:
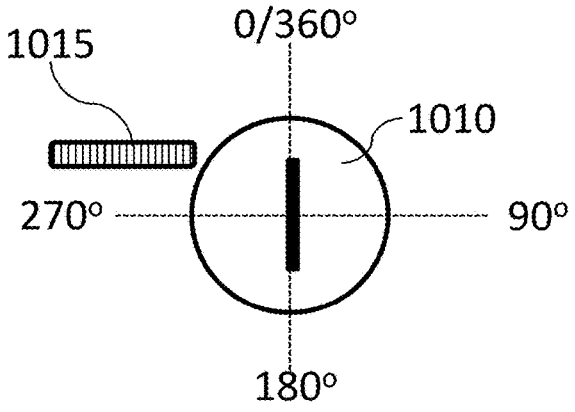
FIGS. 10A-10D are illustrations of various positioning of the cylinder member, in accordance with certain examples.
Figure 10B:
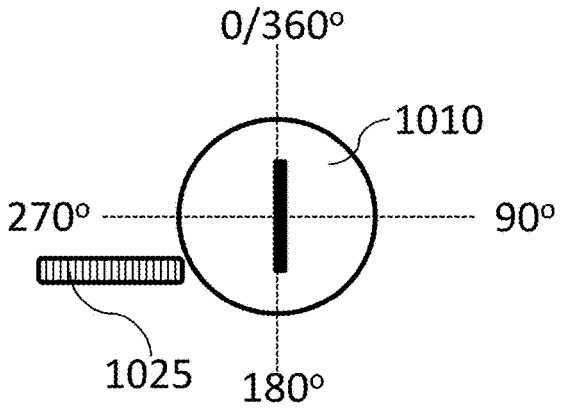
Figure 10C:
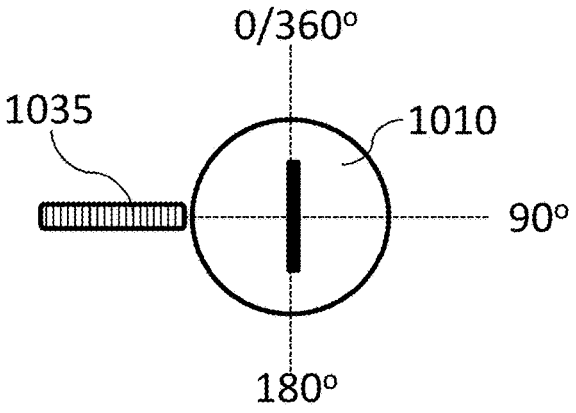
Figure 10D:
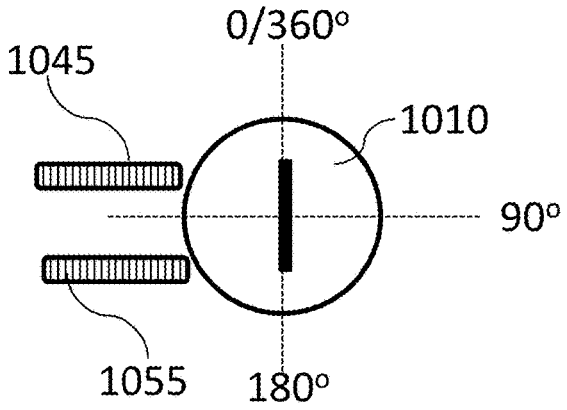
Figure 11A:
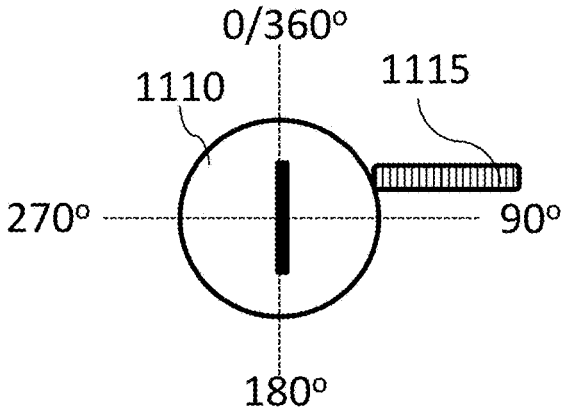
FIGS. 11A-11D are other illustrations of various positioning of the cylinder member, in accordance with certain examples.
Figure 11B:
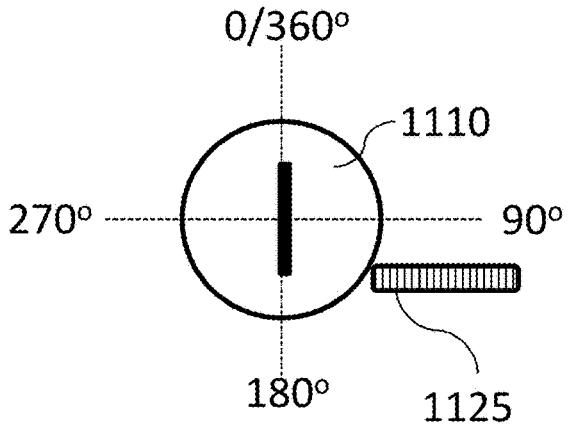
Figure 11C:
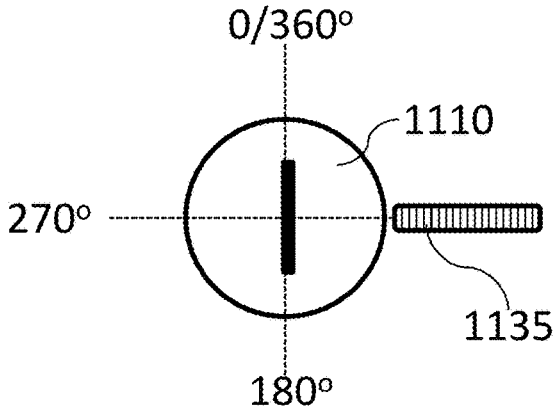
Figure 11D:
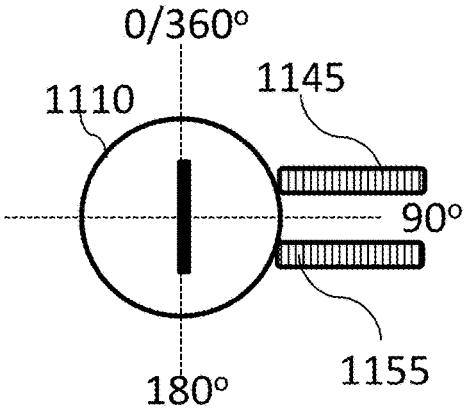

In certain configurations, the exact position of the cylinder member can vary and may depend, for example, on the particular position of the set screws used to retain the lock cylinder in place. Referring to FIG. 10A, a cylinder member 1015 is shown positioned adjacent to a lock cylinder 1010 in a generally orthogonal manner. The cylinder member 1015 is positioned between the 270 degrees and the 360 degrees positions of the lock cylinder 1010. As described herein, the cylinder member 1015 may sit adjacent to the lock cylinder 1010 and permit a set screw (not shown) within the cylinder member 1015, e.g., a set screw within a threaded boss of the cylinder member 1015, to contact the lock cylinder 1010. Referring to FIG. 10B, a cylinder member 1025 is shown positioned adjacent to a lock cylinder 1010 in a generally orthogonal manner. The cylinder member 1025 is positioned between the 180 degrees and the 270 degrees positions of the lock cylinder 1010. The cylinder member 1025 may sit adjacent to the lock cylinder 1010 and permit a set screw (not shown) within the cylinder member 1025, e.g., a set screw within a threaded boss of the cylinder member 1025, to contact the lock cylinder 1010. Referring to FIG. 10C, a cylinder member 1035 is shown positioned adjacent to a lock cylinder 1010 in a generally orthogonal manner. The cylinder member 1035 is positioned at the 270 degree position of the lock cylinder 1010. The cylinder member 1035 may sit adjacent to the lock cylinder 1010 and permit a set screw (not shown) within the cylinder member 1035, e.g., a set screw within a threaded boss of the cylinder member 1035, to contact the lock cylinder 1010. Referring to FIG. 10D, two or more cylinder members 1045, 1055 can be used. Cylinder members 1045, 1055 are shown positioned adjacent to a lock cylinder 1010 in a generally orthogonal manner. The cylinder member 1045 is positioned between the 270 degrees and the 360 degrees position of the lock cylinder 1010, and the cylinder 1055 is shown positioned between the 180 degrees and the 270 degrees position of the lock cylinder 1010. If desired, one of the cylinders 1045, 1055 can be positioned at the 270 degree position of the lock cylinder. Each of the cylinder members 1045, 1055 may sit adjacent to the lock cylinder 1010 and permit a set screw (not shown) within each of the cylinder members 1045, 1055, e.g., a set screw within a threaded boss present in one or both of the cylinder members 1045, 1055, to contact the lock cylinder 1010.

Where the lock is designed to be used on a door which is positioned on the left side of a double entry door, it may be desirable to position the cylinder members between the 0/360 degrees position and the 180 degree position. Referring to FIG. 11A, a cylinder member 1115 is shown positioned adjacent to a lock cylinder 1110 in a generally orthogonal manner. The cylinder member 1115 is positioned between the 0/360 degrees and the 90 degrees positions of the lock cylinder 1110. The cylinder member 1115 may sit adjacent to the lock cylinder 1110 and permit a set screw (not shown) within the cylinder member 1115, e.g., a set screw within a threaded boss of the cylinder member 1115, to contact the lock cylinder 1110. Referring to FIG. 11B, a cylinder member 1125 is shown positioned adjacent to a lock cylinder 1110 in a generally orthogonal manner. The cylinder member 1125 is positioned between the 90 degrees and the 180 degrees positions of the lock cylinder 1110. The cylinder member 1125 may sit adjacent to the lock cylinder 1110 and permit a set screw (not shown) within the cylinder member 1125, e.g., a set screw within a threaded boss of the cylinder member 1125, to contact the lock cylinder 1110. Referring to FIG. 11C, a cylinder member 1135 is shown positioned adjacent to a lock cylinder 1110 in a generally orthogonal manner. The cylinder member 1135 is positioned at the 90 degrees position of the lock cylinder 1110. The cylinder member 1135 may sit adjacent to the lock cylinder 1110 and permit a set screw (not shown) within the cylinder member 1135, e.g., a set screw within a threaded boss of the cylinder member 1135, to contact the lock cylinder 1110. Referring to FIG. 11D, two or more cylinder members 1145, 1155 can be used. Cylinder members 1145, 1155 are shown positioned adjacent to a lock cylinder 1010 in a generally orthogonal manner. The cylinder member 1145 is positioned between the 0/360 degrees and the 90 degrees position of the lock cylinder 1110, and the cylinder 1155 is shown positioned between the 90 degrees and the 180 degrees position of the lock cylinder 1110. If desired, one of the cylinders 1145, 1155 can be positioned at the 90 degrees position of the lock cylinder. Each of the cylinder members 1145, 1155 may sit adjacent to the lock cylinder 1110 and permit a set screw (not shown) within each of the cylinder members 1145, 1155, e.g., a set screw within a threaded boss present in one or both of the cylinder members 1145, 1155, to contact the lock cylinder 1110.

While various cylinder members are shown in FIGS. 10A-11D as being positioned in a substantially orthogonal manner to the longitudinal axis of a lock cylinder, where the cylinder member is positioned substantially parallel to the longitudinal axis of the lock cylinder, the cylinder members can be positioned in similar quadrants as shown in FIGS.

10A-11D. In addition, a lock assembly can be produced with a first cylinder member positioned at about 90 degrees and a second cylinder member positioned at about 270 degrees. The side plate can be coupled to the other plates on the left side or the right side to permit a single lock assembly to be used in a left door configuration or a right door configuration while at the same time permitting use of a cylinder member to provide reinforcement to any set screw used.

Figure 12:
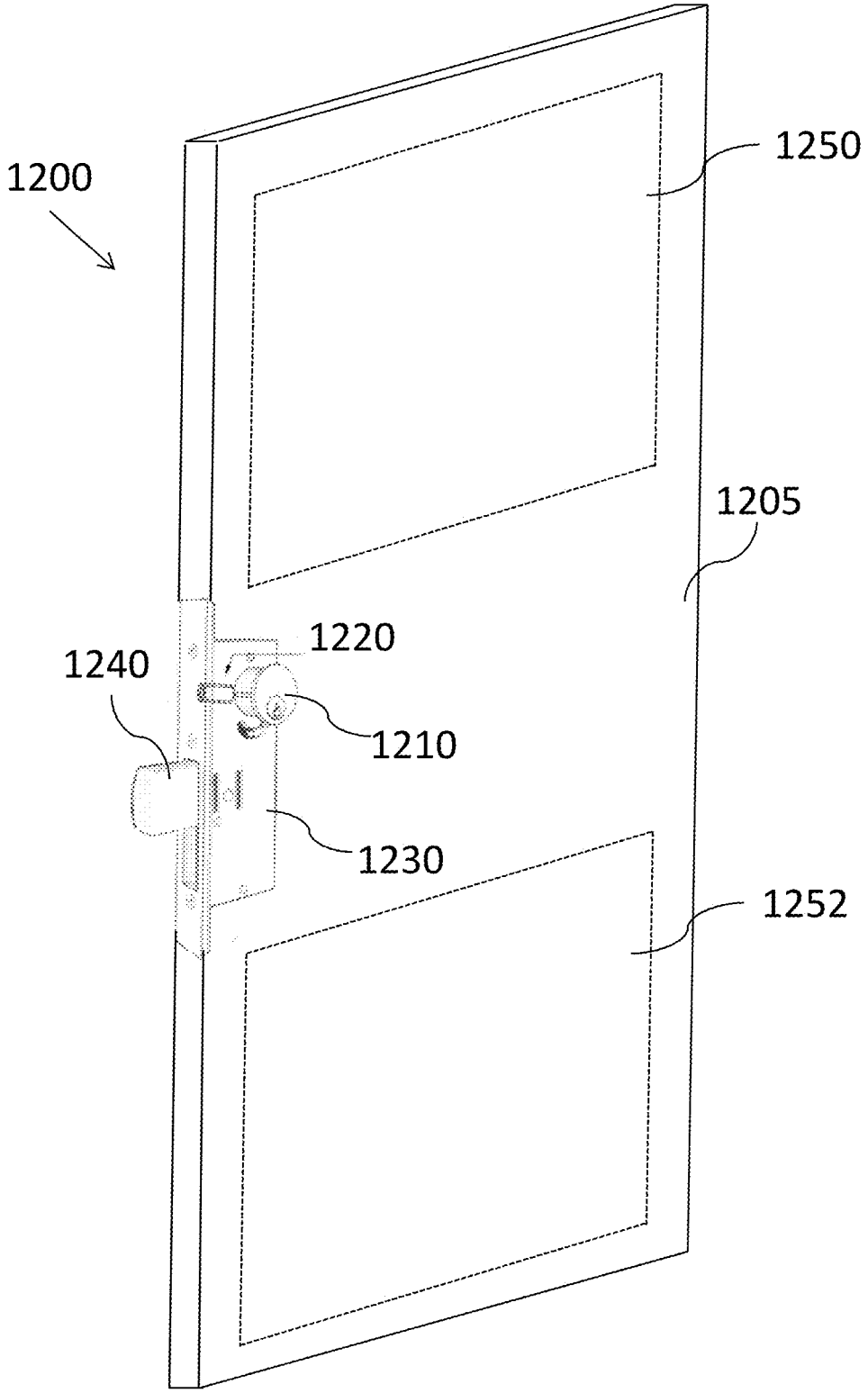
FIG. 12 is an illustration of a door assembly, in accordance with certain examples.

In certain configurations, the lock assemblies described herein can be present in a door assembly that may comprise a door and optionally a door frame. Referring to FIG. 12, a door assembly 1200 comprises a door 1205 and a lock assembly comprising a lock cylinder 1210, a cylinder member 1220 and a latch 1240 that is actuated using the lock cylinder 1210 and a key. The lock assembly may comprise a face plate 1230 and a back plate (not shown). The door assembly 1200 may also comprise optional windows 1250, 1252 (or a single window or no windows at all) if desired. The door 1205 may be produced from wood, steel, plastic, composites or other materials. If desired, the door 1205 may also be insulated, may comprise paint or other aesthetic coatings or coverings and may be present or designed to mate to another door if desired. For example, the door assembly 1200 may be one door, e.g., the right door, of a two door assembly. If desired, the door assembly 1200 may comprise a door frame (not shown), e.g., the door assembly 1200 may be pre-hung, to permit easy installation at the premises.

In certain instances, the various components of the lock assemblies described herein can be present in a lock kit to permit assembly of an operable lock. For example, the kit may comprise a lock cylinder, at least one plate configured to receive a portion of the lock cylinder, and a cylinder member configured to permit engagement of a cylindrical surface of the lock cylinder to deter removal of a lock cylinder after circumferential rotation of the lock cylinder. In some instances, the cylinder member may be permanently coupled to one of the plates present in the kit. If desired, the kit may also comprise instructions for using the lock cylinder, the plate and the cylinder member to provide an operable lock. In some instances, the plate can be configured to engage the base of the lock cylinder, whereas in other instances, the lock cylinder may be held in place by way of set screws inserted in a generally orthogonal direction to the longitudinal axis of the lock cylinder, e.g., the kit may comprise one or more set screws. If desired, the cylinder member can be configured to deter removal of a lock cylinder after circumferential rotation of the lock cylinder by at least 45 degrees or by at least 90 degrees. In some instances, the cylinder member may comprise a threaded boss, e.g., threads that can receive a set screw. In certain configurations, the threaded boss can be configured to permit engagement of the lock cylinder at about 270 degrees, between 270 degrees and 360 degrees or between 180 degrees and 360 degrees. In other instances, the threaded boss can be configured to engage the lock cylinder at about 90 degrees, between 0 degrees and 90 degrees or between 90 degrees and 180 degrees. In some instances, the cylinder member is positioned such that circumferential rotation of the lock cylinder will cause etching of a set screw within the cylinder member into the lock cylinder. Such etching can prevent subsequent removal of the lock cylinder after rotation. If desired, the kit may also comprise a second cylinder member configured to permit engagement of the lock cylinder at another cylindrical surface of the lock cylinder. In some instances, the kit may comprise a face plate or a back plate. The face plate may comprise an integral cylinder member or the back plate may comprise an integral cylinder member.

When introducing elements of the aspects, embodiments and examples disclosed herein, the articles "a," "an," "the" and "said" are intended to mean that there are one or more of the elements. The terms "comprising," "including" and "having" are intended to be open-ended and mean that there may be additional elements other than the listed elements. It will be recognized by the person of ordinary skill in the art, given the benefit of this disclosure, that various components of the examples can be interchanged or substituted with various components in other examples.

Although certain aspects, examples and embodiments have been described above, it will be recognized by the person of ordinary skill in the art, given the benefit of this disclosure, that additions, substitutions, modifications, and alterations of the disclosed illustrative aspects, examples and embodiments are possible.

The invention claimed is:

1. A door lock assembly comprising:

a rotatable lock cylinder comprising a plurality of circumferential grooves and a longitudinal groove parallel to a longitudinal axis of the rotatable lock cylinder, wherein the rotatable lock cylinder is configured to receive a key to actuate a latch assembly to lock and unlock a door comprising the door lock assembly by turning the key;

a face plate configured to receive a portion of the rotatable lock cylinder;

a side plate comprising the latch assembly;

a back plate configured to receive another portion of the rotatable lock cylinder, wherein the back plate is configured to receive screws through the back plate to hold the rotatable lock cylinder in the door lock assembly; and a cylinder member comprising a set screw comprising a terminal point residing in the longitudinal groove of the rotatable lock cylinder without contacting a cylindrical surface of the rotatable lock cylinder when the rotatable lock cylinder is in an initial position, wherein the set screw is positioned at an orthogonal angle to the longitudinal groove and is configured to etch into the cylindrical surface and the circumferential grooves of the rotatable lock cylinder upon circumferential rotation of the rotatable lock cylinder to deter removal of the rotatable lock cylinder after the circumferential rotation of the rotatable lock cylinder from the initial position, wherein the cylinder member is configured to permit the terminal point of the set screw to protrude into the longitudinal groove at no more than a depth of the longitudinal groove of the rotatable lock cylinder when the rotatable lock cylinder is in the initial position, and in which the cylinder member positions the terminal point of the set screw to etch into the rotatable lock cylinder to deter removal of the rotatable lock cylinder after circumferential rotation of the rotatable lock cylinder by at least 45 degrees from the initial position.

2. The door lock assembly of claim 1, in which the cylinder member comprises a threaded boss that positions the set screw adjacent to the longitudinal groove without contacting the rotatable lock cylinder in the initial position.

3. A door lock assembly comprising:

a rotatable lock cylinder comprising a plurality of circumferential grooves and a longitudinal groove parallel to a longitudinal axis of the rotatable lock cylinder, wherein the rotatable lock cylinder is configured to receive a key to actuate a latch assembly to lock and unlock a door comprising the door lock assembly by turning the key;

a face plate configured to receive a portion of the rotatable lock cylinder;

a side plate comprising the latch assembly;

a back plate configured to receive another portion of the rotatable lock cylinder, wherein the back plate is configured to receive screws through the back plate to hold the rotatable lock cylinder in the door lock assembly; and a cylinder member comprising a set screw comprising a terminal point residing in the longitudinal groove of the rotatable lock cylinder without contacting a cylindrical surface of the rotatable lock cylinder when the rotatable lock cylinder is in an initial position, wherein the set screw is positioned at an orthogonal angle to the longitudinal groove and is configured to etch into the cylindrical surface and the circumferential grooves of the rotatable lock cylinder upon circumferential rotation of the rotatable lock cylinder to deter removal of the rotatable lock cylinder after the circumferential rotation of the rotatable lock cylinder from the initial position, wherein the cylinder member is configured to permit the terminal point of the set screw to protrude into the longitudinal groove at no more than a depth of the longitudinal groove of the rotatable lock cylinder when the rotatable lock cylinder is in the initial position, in which the cylinder member comprises a threaded boss that positions the set screw adjacent to the longitudinal groove without contacting the rotatable lock cylinder in the initial position, and in which the threaded boss is configured to permit the terminal point of the set screw to etch into the rotatable lock cylinder at about a 90 degree position from the initial position of the rotatable lock cylinder or to etch into the rotatable lock cylinder at about a 270 degree position from the initial position of the rotatable lock cylinder.

4. The door lock assembly of claim 1, further comprising a second cylinder member comprising a second set screw comprising a terminal point residing in a second longitudinal groove of the rotatable lock cylinder, wherein the second set screw is positioned at an orthogonal angle to the second longitudinal groove of the rotatable lock cylinder and is configured to etch into the circumferential grooves of the rotatable lock cylinder, upon the circumferential rotation of the rotatable lock cylinder, at a different cylindrical surface of the rotatable lock cylinder than the cylindrical surface of the rotatable lock cylinder etched into by the terminal point of the set screw.

5. A door lock kit comprising a door lock assembly that comprises (i) a rotatable lock cylinder comprising a plurality of circumferential grooves and a longitudinal groove parallel to a longitudinal axis of the rotatable lock cylinder, wherein the rotatable lock cylinder is configured to receive a key to actuate a latch assembly to lock and unlock a door comprising the door lock assembly by turning the key, (ii) a face plate configured to receive a portion of the rotatable lock cylinder, (iii) a side plate comprising the latch assembly, (iv) a back plate configured to receive another portion of the rotatable lock cylinder, wherein the back plate is configured to receive screws through the back plate to hold the rotatable lock cylinder in the door lock assembly, (v) a set screw and (vi) a cylinder member configured to receive the set screw and configured to position a terminal point of the set screw in the longitudinal groove of the rotatable lock cylinder without contacting the rotatable lock cylinder when the rotatable lock cylinder is in an initial position, wherein the cylinder member is configured to position the set screw at an orthogonal angle to the longitudinal groove and is configured to permit the terminal point of the set screw to etch into the circumferential grooves of the rotatable lock cylinder upon circumferential rotation of the rotatable lock cylinder to deter removal of the rotatable lock cylinder after the circumferential rotation of the rotatable lock cylinder from the initial position, wherein the cylinder member is configured to permit the terminal point of the set screw to protrude into the longitudinal groove at no more than a depth of the longitudinal groove of the rotatable lock cylinder when the rotatable lock cylinder is in an initial position prior to any circumferential rotation of the rotatable lock cylinder, and in which the cylinder member positions the terminal point of the set screw to etch into the circumferential grooves to deter removal of the rotatable lock cylinder after circumferential rotation of the rotatable lock cylinder by at least 45 degrees from the initial position.

6. The door lock kit of claim 5, in which the cylinder member comprises a threaded boss configured to receive the set screw and position the set screw adjacent to the longitudinal groove without contacting the rotatable lock cylinder in the initial position.

7. The door lock kit of claim 5, further comprising a second cylinder member comprising a second set screw comprising a terminal point residing in a second longitudinal groove of the rotatable lock cylinder, wherein the second set screw is positioned at an orthogonal angle to the second longitudinal groove of the rotatable lock cylinder and is configured to etch into the circumferential grooves of the rotatable lock cylinder, upon circumferential rotation of the rotatable lock cylinder, at a different position of the rotatable lock cylinder than a position of the rotatable lock cylinder etched by the terminal point of the set screw.

* * * * *